US009608382B2

(12) United States Patent
McClellan et al.

(10) Patent No.: US 9,608,382 B2
(45) Date of Patent: Mar. 28, 2017

(54) HEADER TRANSITION CONNECTOR FOR AN ELECTRICAL CONNECTOR SYSTEM

(71) Applicants: Tyco Electronics Corporation, Berwyn, PA (US); TE Connectivity Nederland B.V., s'Hertogenbosch (NL); Tyco Electronics Belgium EC BVBA, Oostkamp (BE)

(72) Inventors: Justin Shane McClellan, Camp Hill, PA (US); Jeffrey Byron McClinton, Harrisburg, PA (US); Lieven Decrock, Roeselare (BE); Han van het Bolscher, Tilburg (NL)

(73) Assignees: TE CONNECTIVITY CORPORATION, Berwyn, PA (US); TE CONNECTIVITY NEDERLAND B.V. (NL); TYCO ELECTRONICS BELGIUM EC BVBA (BE)

( * ) Notice: Subject to any disclaimer, the term of this patent is extended or adjusted under 35 U.S.C. 154(b) by 0 days.

(21) Appl. No.: 14/526,162

(22) Filed: Oct. 28, 2014

(65) Prior Publication Data

US 2016/0118751 A1 Apr. 28, 2016

(51) Int. Cl.
*H01R 13/648* (2006.01)
*H01R 13/6587* (2011.01)

(52) U.S. Cl.
CPC ..... *H01R 13/6587* (2013.01)

(58) Field of Classification Search
CPC ..... H01R 23/688; H01R 13/6594; H01R 13/6585; H01R 13/6587
USPC ..... 439/607.07–607.1
See application file for complete search history.

(56) References Cited

U.S. PATENT DOCUMENTS 6,899,566 B2 * 5/2005 Kline ..... H01R 13/514 439/108
7,485,001 B2 * 2/2009 Chen ..... H01R 13/65802 439/607.05
8,016,616 B2 * 9/2011 Glover ..... H01R 12/585 439/607.05
8,167,651 B2 5/2012 Glover et al.
8,419,472 B1 * 4/2013 Swanger ..... H01R 13/6587 439/607.07

(Continued)

FOREIGN PATENT DOCUMENTS

TW 307240 U 3/2007

*Primary Examiner* — Abdullah Riyami
*Assistant Examiner* — Thang Nguyen

(57) ABSTRACT

A header transition connector includes a header housing having a separating wall separating a first cavity from a second cavity. Header signal contacts are held by the header housing. The header signal contacts are arranged in pairs carrying differential signals. The header signal contacts have first mating ends in the first cavity for mating with a first receptacle connector. The header signal contacts have second mating ends in the second cavity for mating with a second receptacle connector. Header ground shields are held by the header housing. The header ground shields have first mating ends in the first cavity for mating with the first receptacle connector. The header ground shields have second mating ends in the second cavity for mating with the second receptacle connector. At least a group of the header ground shields are electrically commoned with each other within the header housing.

21 Claims, 11 Drawing Sheets

(56) References Cited

U.S. PATENT DOCUMENTS

| | | | | |
|---|---|---|---|---|
| 8,430,691 | B2 * | 4/2013 | Davis | H01R 13/6585 439/607.09 |
| 8,500,487 | B2 | 8/2013 | Morgan et al. | |
| 8,628,356 | B2 * | 1/2014 | Laurx | H01R 12/737 439/628 |
| 8,641,448 | B2 * | 2/2014 | Lappoehn | H01R 23/688 439/607.09 |
| 8,870,594 | B2 * | 10/2014 | McClellan | H01R 9/22 439/607.05 |
| 2011/0143591 | A1 * | 6/2011 | Davis | H01R 13/6587 439/607.27 |
| 2014/0051295 | A1 * | 2/2014 | Westman | H01R 13/514 439/626 |
| 2014/0106583 | A1 * | 4/2014 | Vino, IV | H01R 13/6587 439/95 |
| 2014/0120770 | A1 * | 5/2014 | Nguyen | H01R 13/6585 439/607.34 |
| 2015/0031238 | A1 * | 1/2015 | Davis | H01R 23/688 439/607.05 |
| 2015/0104977 | A1 * | 4/2015 | Hamner | H01R 12/716 439/626 |
| 2015/0236450 | A1 * | 8/2015 | Davis | H01R 12/71 439/78 |

* cited by examiner

HEADER TRANSITION CONNECTOR FOR AN ELECTRICAL CONNECTOR SYSTEM

BACKGROUND OF THE INVENTION

The subject matter herein relates generally to a header transition connector for use in an electrical connector system.

Some electrical systems, such as network switches and computer servers with switching capability, include receptacle connectors that are oriented orthogonally on opposite sides of a midplane in a cross-connect application. Switch cards may be connected on one side of the midplane and line cards may be connected on the other side of the midplane. The line card and switch card are joined through header connectors that are mounted on opposite sides of the midplane board. Using the midplane circuit board and header connectors adds to the cost and overall size of the electrical systems. Some known electrical systems have eliminated the midplane and header connectors by designing two connectors that mate directly to one another. But, midplanes typically include circuitry that cancels noise generated when passing an array of signals between the receptacle connectors. For example, signal noise may be generated from the array of signals passing through electrical vias of the switch and line cards and/or from the array of signals passing through the signal contacts of the receptacle connectors. Such known electrical systems having two connectors that mate directly together therefore may suffer from unwanted signal noise because of the absence of the midplane.

A need remains for an improved electrical connector system for mating receptacle connectors without a midplane circuit board.

BRIEF DESCRIPTION OF THE INVENTION

In an embodiment, a header transition connector includes a header housing having a separating wall separating a first cavity from a second cavity. Header signal contacts are held by the header housing. The header signal contacts are arranged in pairs carrying differential signals. The header signal contacts have first mating ends in the first cavity for mating with a first receptacle connector. The header signal contacts have second mating ends in the second cavity for mating with a second receptacle connector. Header ground shields are held by the header housing. The header ground shields have walls surrounding associated pairs of header signal contacts on at least two sides thereof. The header ground shields have first mating ends in the first cavity for mating with the first receptacle connector. The header ground shields have second mating ends in the second cavity for mating with the second receptacle connector. At least a group of the header ground shields are electrically commoned with each other within the header housing.

In an embodiment, a header transition connector includes a header housing having a separating wall separating a first cavity from a second cavity. Header signal contacts are held by the header housing. The header signal contacts are arranged in pairs carrying differential signals. The header signal contacts have first mating ends in the first cavity for mating with a first receptacle connector. The header signal contacts have second mating ends in the second cavity for mating with a second receptacle connector. Header ground shields are held by the header housing. The header ground shields have walls surrounding associated pairs of header signal contacts on at least two sides thereof. The header ground shields have first mating ends in the first cavity for mating with the first receptacle connector. The header ground shields have second mating ends in the second cavity for mating with the second receptacle connector. A first of the header ground shields is engaged in physical contact with a second of the header ground shields such that the first and second header ground shields are electrically connected together.

In an embodiment, an electrical connector system includes a receptacle connector having receptacle signal contacts arranged in pairs carrying differential signals. The receptacle connector includes a ground shield having ground contacts extending therefrom. A header transition connector is coupled to the receptacle connector. The header transition connector includes a header housing holding header signal contacts and header ground shields. The header housing have a separating wall separating a first cavity from a second cavity. The receptacle connector is configured to be received in the first cavity. The header signal contacts are arranged in pairs carrying differential signals. The header signal contacts have first mating ends that extend in the first cavity and are configured to be mated with the receptacle signal contacts of the receptacle connector. The header signal contacts have second mating ends that extend in the second cavity for mating with a second receptacle connector. The header ground shields have first mating ends in the first cavity for mating with the ground contacts of the receptacle connector. The header ground shields have second mating ends in the second cavity for mating with the second receptacle connector. A first of the header ground shields is engaged in physical contact with a second of the header ground shields such that the first and second header ground shields are electrically connected together.

DETAILED DESCRIPTION OF THE INVENTION

Figure 1:
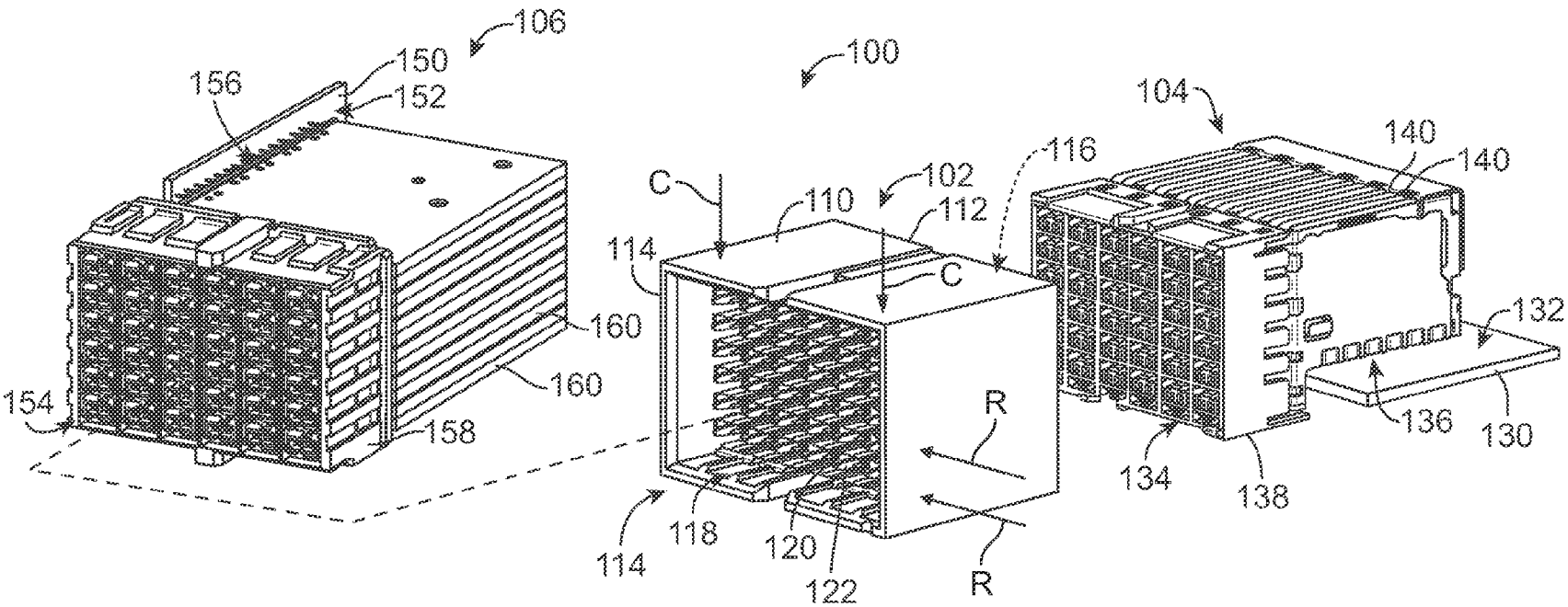
FIG. 1 is a perspective view of an embodiment of an electrical connector system.

FIG. 1 is a perspective view of an embodiment of an electrical connector system 100. The electrical connector system 100 includes a header transition connector 102, a first receptacle connector 104 configured to be coupled to one side of the header transition connector 102, and a second receptacle connector 106 configured to be connected to another side the header transition connector 102. The header transition connector 102 is used to electrically connect the first and second receptacle connectors 104 and 106 together. Optionally, the first receptacle connector 104 is part of a daughter card and the second receptacle connector 106 is, or forms a portion of, a backplane, or vice versa. The first and second receptacle connectors 104 and/or 106 may be, and/or may form a portion of, a line card and/or a switch card.

The header transition connector 102 makes direct electrical connections to both receptacle connectors 104 and 106 without the need for a midplane circuit board (not shown). The header transition connector 102 is a single connector that is able to electrically interconnect the two receptacle connectors 104 and 106. Each of the receptacle connectors 104 and 106 may be any type of receptacle connector, such as, but not limited to, STRADA Whisper receptacle connectors commercially available from TE Connectivity, Harrisburg PA. The header transition connector 102 allows convenient electrical connection between the receptacle connectors 104 and 106, with few parts and without the need for a midplane circuit board.

As will be described below, the header transition connector 102 includes header ground shields 122. At least some (e.g., a group as will be described below) of the header ground shields 122 are electrically commoned with each other within a header housing 110 (described below) of the header transition connector 102. Electrically commoning at least some of the header ground shields 122 within the header housing 110 may provide an electrical connector system 100 that mates the receptacle connectors 104 and 106 together without a midplane circuit board but that behaves electrically as if a midplane circuit board is present.

In an exemplary embodiment, the header transition connector 102 may be coupled to one of the receptacle connectors (e.g., the first receptacle connector 104) to change the mating interface presented to the other receptacle connector (e.g., the second receptacle connector 106). For example, the first receptacle connector 104 may have contacts each having a receptacle type mating end, such as, but not limited to, a split beam type of contact that defines a receptacle. The second receptacle connector 106 may have similar or identical contacts as the first receptacle connector 104, such as, but not limited to, split beam type of contacts that define receptacles. The receptacle connectors 104 and 106 have mating interfaces that do not allow direct mating therebetween; however, the header transition connector 102 is able to mate directly with the first receptacle connector 104 and is able to mate directly with the second receptacle connector 106. The header transition connector 102 is an adaptor that facilitates electrical interconnection of the receptacle connectors 104 and 106. For example, the header transition connector 102 may include pin-type contacts at both mating interfaces of the header transition connector 102 that are able to be mated with the receptacle type contacts of both of the receptacle connectors 104 and 106. In such an example, mounting the header transition connector 102 to the first receptacle connector 104 changes the mating interface presented to the second receptacle connector 106 from a receptacle contact type of interface to a pin contact type of interface. The header transition connector 102 thus defines an adapter that changes the mating interface of the receptacle connector 104 for mating with another connector, for example the receptacle connector 106, that could not mate directly with the receptacle connector 104.

The header transition connector 102 includes the header housing 110 having a first end 112 and a second end 114. The header housing 110 defines a first cavity 116 (visible in FIGS. 4 and 5) at the first end 112 and a second cavity 118 at the second end 114. In an exemplary embodiment, the first cavity 116 receives the first receptacle connector 104 and the second cavity 118 receives the second receptacle connector 106. The header transition connector 102 includes header signal contacts 120 held by the header housing 110 and header ground shields 122 held by the header housing 110. The header signal contacts 120 are arranged in both the cavities 116 and 118 for mating with the first and second receptacle connectors 104 and 106. Optionally, the header signal contacts 120 may be arranged in pairs carrying differential signals. The header ground shields 122 are arranged in both the cavities 116 and 118 for mating with both of the receptacle connectors 104 and 106. The header ground shields 122 provide electrical shielding for the header signal contacts 120.

In the illustrated embodiment, the header signal contacts 120 have an identical pinout in both the cavities 116 and 118 allowing the first receptacle connector 104 to be loaded into either the first cavity 116 or the second cavity 118. Similarly, the second receptacle connector 106 may be loaded into either the first cavity 116 or the second cavity 118. Optionally, identical receptacle connectors may be loaded into both cavities 116 and 118 for electrical connection by the header transition connector 102. For example, two receptacle connectors that are identical to the first receptacle connector 104 (which may be referred to as "pair-in-row" receptacle connectors) may be plugged into the cavities 116 and 118. Alternatively, two receptacle connectors that are identical to the second receptacle connector 106 (which may be referred to as "pair-in-column" receptacle connectors) may be plugged into the cavities 116 and 118. The header transition connector 102 can accommodate either type of receptacle connector 104 or 106 in either cavity 116 or 118.

Each of the header ground shields 122 peripherally surrounds an associated pair of the header signal contacts 120 in the illustrated embodiment. Moreover, the illustrated embodiment of the header ground shields 122 are C-shaped, covering three sides of the associated pair of header signal contacts 120. One side of the header ground shield 122 is open. In the illustrated embodiment, each of the header ground shields 122 has an open bottom, and an adjacent header ground shield 122 below the open bottom provides shielding across the open bottom. Each pair of header signal contacts 120 is therefore surrounded on all four sides thereof by the associated C-shaped header ground shield 122 and the adjacent header ground shield 122 below the pair of header signal contacts 120. As such, the header ground shields 122 cooperate to provide circumferential electrical shielding for each pair of header signal contacts 120. The header ground shields 122 electrically shield each pair of header signal contacts 120 from every other pair of header signal contacts 120. For example, the header ground shields 122 may span all direct line paths from any one pair of the header signal contacts 120 to any other pair of the header signal contacts 120 to provide electrical shielding across all of the direct line paths. In the illustrated embodiment, the header ground shield 122 spans entirely across the top of both header signal contacts within the associated pair. The header ground shield 122 may provide better electrical shielding than individual header ground contacts of at least some known header assemblies.

In some other embodiment, other types of header ground shields 122 may be provided. For example, L-shaped header ground shields 122 may be used that provide shielding on two sides of the associated pair of header signal contacts 120, wherein cooperation with other header ground shields 122 provides electrical shielding on all sides (e.g. above, below, and on both sides of the pair). In some other embodiments, and for example, the header ground shields 122 may be associated with individual header signal contacts 120 as opposed to pairs of header signal contacts 120.

The first receptacle connector 104 is mounted to a first circuit board 130 at a mounting surface 132 of the first circuit board 130. The first receptacle connector 104 has a header interface 134 configured to be mated with the header transition connector 102. The first receptacle connector 104 has a board interface 136 configured to be mounted to the mounting surface 132 of the first circuit board 130. In the illustrated embodiment, the board interface 136 is orientated perpendicular to the header interface 134. When the first receptacle connector 104 is coupled to the header transition connector 102, the first circuit board 130 is orientated horizontally with the first receptacle connector 104 above the first circuit board 130; however, other orientations are possible in other embodiments.

The first receptacle connector 104 includes a first receptacle housing 138 used to hold a plurality of first contact modules 140. The contact modules 140 are held in a stacked configuration generally parallel to one another. In the illustrated embodiment, the contact modules 140 are oriented generally along vertical planes. The contact modules 140 hold a plurality of first receptacle signal contacts 142 (shown in FIG. 2) that are electrically connected to the first circuit board 130 and define signal paths through the first receptacle connector 104. The receptacle signal contacts 142 are configured to be electrically connected to the header signal contacts 120. The contact modules 140 optionally provide electrical shielding for the receptacle signal contacts 142. Optionally, the receptacle signal contacts 142 may be arranged in pairs carrying differential signals. The contact modules 140 may generally provide 360° shielding for each pair of receptacle signal contacts 142 along substantially the entire length of the receptacle signal contacts 142 between the board interface 136 and the header interface 134. The shield structure of the contact modules 140 that provides the electrical shielding for the pairs of receptacle signal contacts 142 is electrically connected to the header ground shields 122 and is electrically connected to a ground plane of the first circuit board 130.

In the illustrated embodiment, mating ends of the receptacle signal contacts 142 are arranged in an array in rows and columns (contained within the receptacle housing 138 and thus not shown in FIG. 1; however the pattern is evident from the arrangement of the openings in the receptacle housing 138). The receptacle signal contacts 142 within each contact module 140 define a column of signal contacts. The rows are defined as being oriented parallel to the mounting surface 132 of the first circuit board 130. In the illustrated embodiment, the columns are oriented vertically and the rows are oriented horizontally. The receptacle signal contacts 142 within each pair are arranged in a same row, and thus the first receptacle connector 104 defines a pair-in-row receptacle connector. The receptacle signal contacts 142 within each contact module 140 are in a same column. Optionally, the contact modules 140 are manufactured using overmolded leadframes and the receptacle signal contacts 142 from a same leadframe are within a same column. The receptacle signal contacts 142 within each pair optionally are arranged in a same contact module 140.

The second receptacle connector 106 is mounted to a second circuit board 150 at a mounting surface 152 of the second circuit board 150. The second receptacle connector 106 is configured to be coupled to the header transition connector 102. The second receptacle connector 106 has a header interface 154 configured to be mated with the header transition connector 102. The second receptacle connector 106 has a board interface 156 configured to be mounted to the mounting surface 152 of the second circuit board 150. In the illustrated embodiment, the board interface 156 is orientated perpendicular to the header interface 154. When the second receptacle connector 106 is coupled to the header transition connector 102, the second circuit board 150 is orientated vertically with the second receptacle connector 106 along one side of the second circuit board 150; however, other orientations are possible in other embodiments. Optionally, the second circuit board 150 is oriented perpendicular to the first circuit board 130, as is shown in the illustrated embodiment.

The second receptacle connector 106 includes a second receptacle housing 158 used to hold a plurality of second contact modules 160. The contact modules 160 are held in a stacked configuration generally parallel to one another. In the illustrated embodiment, the contact modules 160 are oriented generally along horizontal planes. The contact modules 160 hold a plurality of receptacle signal contacts 162 (shown in FIG. 3) that are electrically connected to the second circuit board 150 and define signal paths through the second receptacle connector 106. The receptacle signal contacts 162 are configured to be electrically connected to the header signal contacts 120. In an exemplary embodiment, the contact modules 160 provide electrical shielding for the receptacle signal contacts 162. Optionally, the receptacle signal contacts 162 may be arranged in pairs carrying differential signals. The contact modules 160 may generally provide 360° shielding for each pair of receptacle signal contacts 162 along substantially the entire length of the receptacle signal contacts 162 between the board interface 156 and the header interface 154. The shield structure of the contact modules 160 that provides electrical shielding for the pairs of receptacle signal contacts 162 is electrically connected to the header ground shields 122 of the header transition connector 102 and is electrically connected to a ground plane of the second circuit board 150.

In the illustrated embodiment, mating ends of the receptacle signal contacts 162 are arranged in an array in rows and columns (contained within the receptacle housing 158 and thus not shown in FIG. 1; however, the pattern is evident from the arrangement of the openings in the receptacle housing 158). The receptacle signal contacts 162 within each contact module 160 define a column of signal contacts. The rows are defined as being oriented parallel to the mounting surface 152 of the second circuit board 150. In the illustrated embodiment, the columns are oriented horizontally and the rows are oriented vertically. The receptacle signal contacts 162 within each pair are arranged in a same column, and thus the second receptacle connector 106 defines a pair-in-column receptacle connector. The receptacle signal contacts 162 within each contact module 160 are in a same column. Optionally, the contact modules 160 are manufactured using overmolded leadframes and the receptacle signal contacts 162 from a same leadframe are within a same column. Optionally, the receptacle signal contacts 162 within each pair are arranged in a same contact module 160.

Figure 2:
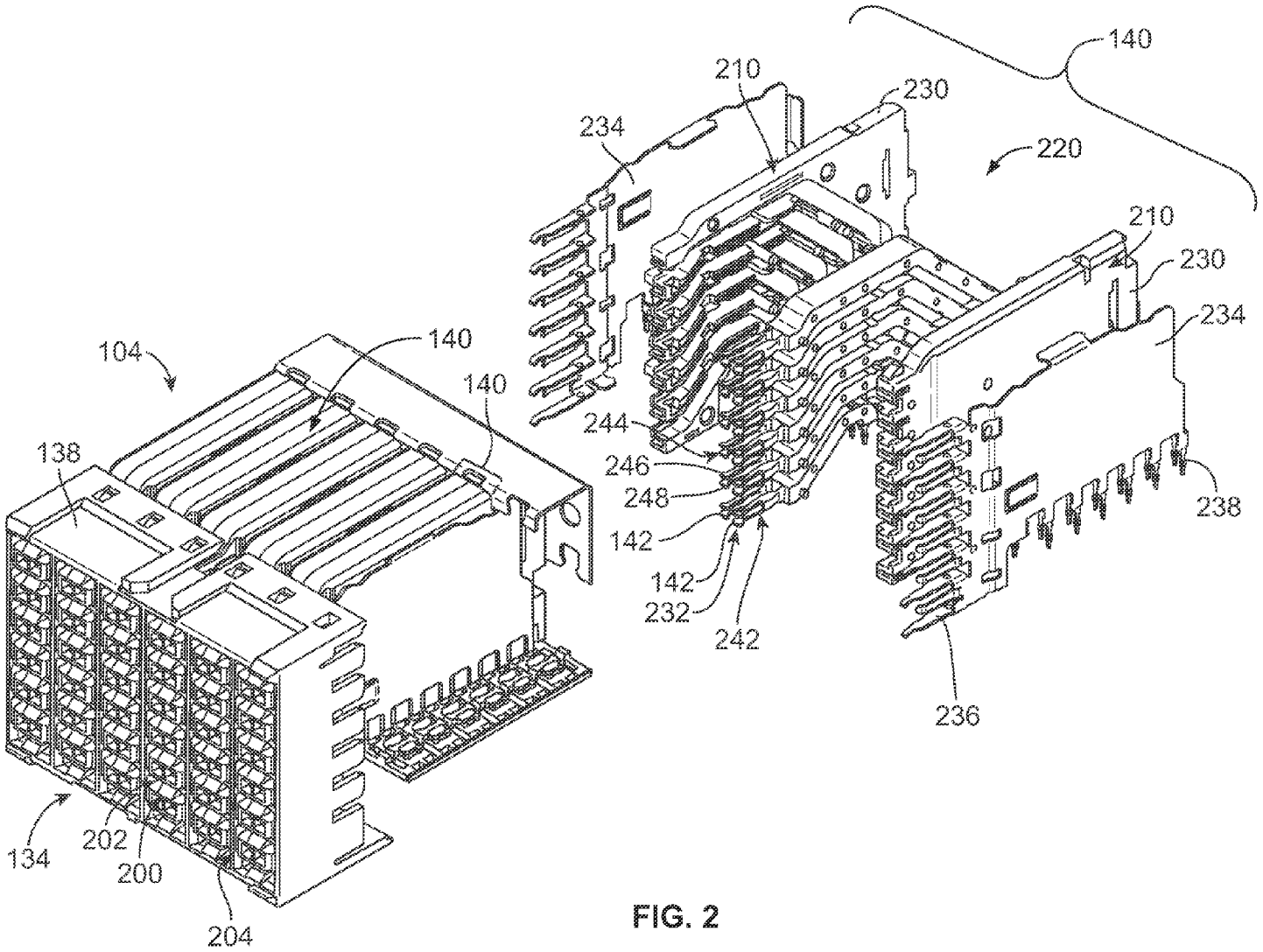
FIG. 2 is a front, partially exploded perspective view of an embodiment of a first receptacle connector of the electrical connector system shown in FIG. 1.

FIG. 2 is a front, partially exploded perspective view of an embodiment of the first receptacle connector 104. The first receptacle housing 138 is manufactured from a dielectric material, such as, but not limited to, a plastic material. The first receptacle housing 138 includes a plurality of signal contact openings 200 and a plurality of ground contacts openings 202 that are through passages extending from the mating end 204 through the first receptacle housing 138. The mating end 204 defines a portion of the header interface 134 of the first receptacle connector 104.

The contact modules 140 are coupled to the first receptacle housing 138 such that the receptacle signal contacts 142 are received in corresponding signal contact openings 200. Optionally, a single receptacle signal contact 142 is received in each signal contact opening 200. The signal contact openings 200 may also receive corresponding header signal contacts 120 (shown in FIGS. 1, 4, 5, 8, and 12) therein when the receptacle connector 104 is coupled to the header transition connector 102 (shown in FIGS. 1, 2, 11, and 12).

The ground contact openings 202 receive corresponding header ground shields 122 (shown in FIGS. 1, 4-10, and 12) therein when the receptacle connector 104 is coupled to the header transition connector 102. The ground contact openings 202 receive grounding members (e.g., grounding contacts 236 of the contact modules 140), which mate with the header ground shields 122 to electrically common the grounding contacts 236 and the header ground shields 122. The ground contact openings 202 are C-shaped in the illustrated embodiment to receive the C-shaped header ground shields 122. Other shapes are possible in other embodiments, for example when other shaped header ground shields 122 are used.

The contact modules 140 each include a holder 210 that holds a frame assembly 220. Optionally, the holder 210 may be an electrically conductive holder to provide electrical shielding, for example a holder manufactured from a metal material and/or a metalized plastic material. The frame assembly 220 includes a dielectric frame 230 surrounding a leadframe 232. Optionally, the leadframe 232 is stamped and formed to define the receptacle signal contacts 142. Other manufacturing processes may be utilized to form the contact modules 140.

The conductive holder 210 provides electrical shielding for the receptacle signal contacts 142. The conductive holder 210 may include portions that are positioned between some or all of the receptacle signal contacts 142 to provide electrical shielding. Optionally, a shield 234 may be coupled to the holder 210. The shield 234 includes the grounding contacts 236 and grounding pins 238, which may be electrically terminated to the circuit board 130.

Although not shown in FIG. 2, it should be apparent from the exploded portion of FIG. 2 that the receptacle signal contacts 142 have mating portions 242 that extend from the front wall of the dielectric frame 230. The mating portions 242 are configured to be mated with, and electrically connected to, corresponding header signal contacts 120 (shown in FIGS. 1, 4, 5, 8, and 12). The mating portions 242 within each contact module 140 are arranged in a column. The mating portions 242 define receptacle type mating ends having a receptacle 244 that is configured to receive a pin type contact, such as the header signal contact 120. In the illustrated embodiment, each mating portion 242 is a split beam type of contact having opposed beams 246 and 248 defining and flanking the receptacle 244. Other types of mating portions may be provided in other embodiments.

The mating portions 242, the grounding contacts 236, and the first receptacle housing 138 together define the header interface 134. For example, the size and shape of the perimeter of the first receptacle housing 138 as well as the shapes and positions of the mating portions 242 and the grounding contacts 236 define the header interface 134. For example, the mating portions 242 have a predetermined pinout defined by the relative positions of the mating portions 242. The header interface 134 is configured for mating with the header transition connector 102 (shown in FIGS. 1, 4, 5, and 8-12).

The receptacle signal contacts 142 are optionally arranged as differential pairs. The pair of receptacle signal contacts 142 is arranged in a row, which defines the receptacle connector 104 as a pair-in-row receptacle connector 104. The conductive holders 210 may be designed to provide electrical shielding between and around respective pairs of the receptacle signal contacts 142. The conductive holders 210 may provide 360° shielding around each pair of receptacle signal contacts 142. The conductive holders 210 provide shielding from electromagnetic interference (EMI) and/or radio frequency interference (RFI).

Figure 3:
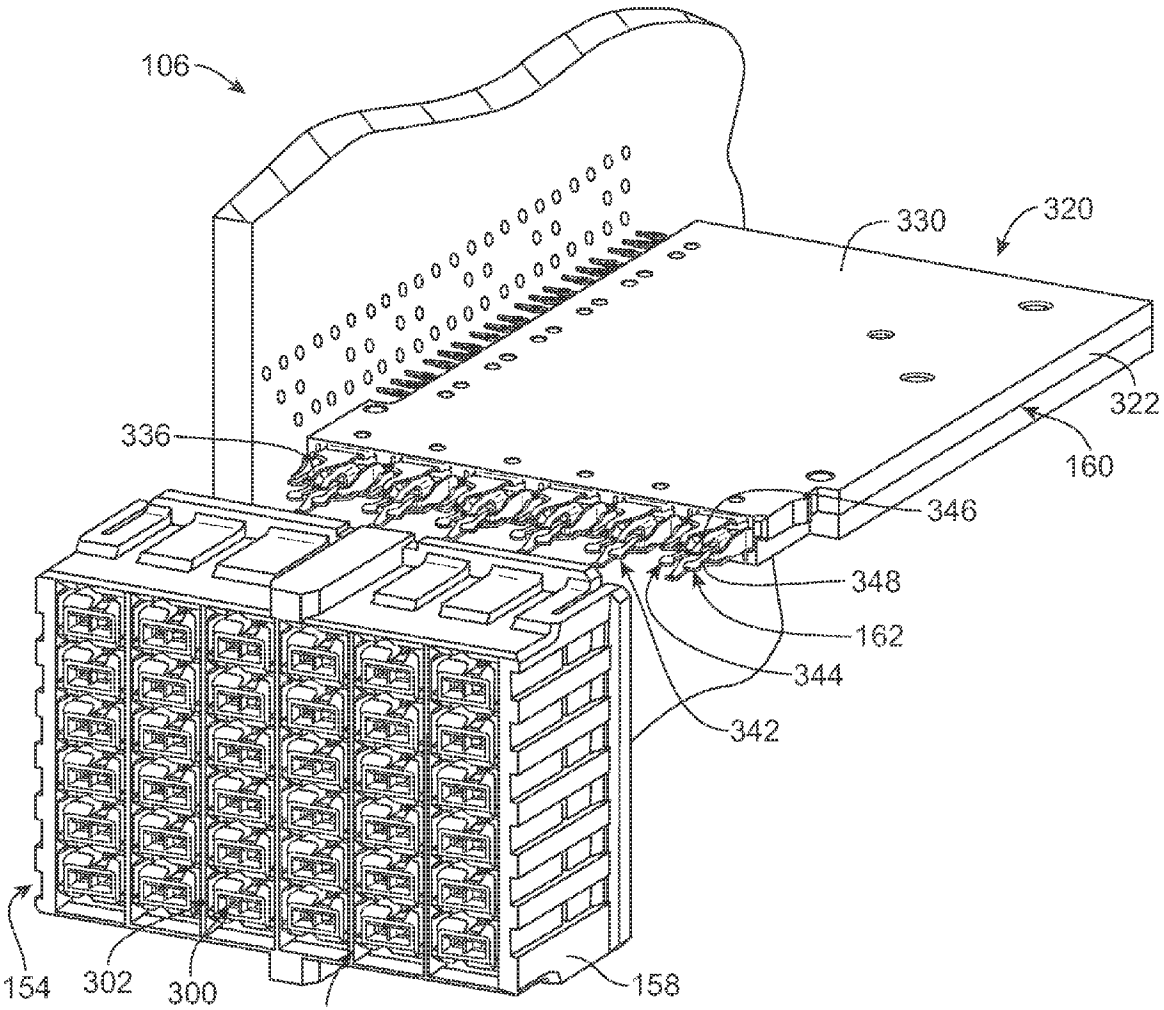
FIG. 3 is a front perspective view of a portion of an embodiment of a second receptacle connector of the electrical connector system shown in FIG. 1.

FIG. 3 is a front perspective view of a portion of an embodiment of the second receptacle connector 106. FIG. 3 illustrates one of the contact modules 160 poised for loading into the second receptacle housing 158. The second receptacle housing 158 is manufactured from a dielectric material, such as, but not limited to, a plastic material. The second receptacle housing 158 includes a plurality of signal contact openings 300 and a plurality of ground contacts openings 302 that are through passages that extend from a mating end 304 through the second receptacle housing 158. The mating end 304 defines a portion of the header interface 154 of the second receptacle connector 106.

The contact module 160 is coupled to the second receptacle housing 158 such that the receptacle signal contacts 162 are received in corresponding signal contact openings 300. Optionally, a single receptacle signal contact 162 is received in each signal contact opening 300. The signal contact openings 300 may also receive corresponding header signal contacts 120 (shown in FIGS. 1, 4, 5, 8, and 12) therein when the receptacle connector 106 is mated with the header transition connector 102 (shown in FIGS. 1, 4, 5, and 8-12).

The ground contact openings 302 receive corresponding header ground shields 122 (shown in FIGS. 1, 4-10, and 12) therein when the receptacle connector 106 is mated with the header transition connector 102. The ground contact openings 302 receive grounding members, for example grounding contacts 336 of the contact modules 160, which mate with the header ground shields 122. The ground contact openings 302 are C-shaped in the illustrated embodiment to receive the C-shaped header ground shields 122. Other shapes are possible in other embodiments, such as, but not limited to, when other shaped header ground shields 122 are used.

The contact module 160 includes a frame assembly 320, which includes the receptacle signal contacts 162. The receptacle signal contacts 162 are arranged in pairs carrying differential signals. Optionally, the frame assembly 320 includes a dielectric frame 322 that surrounds the receptacle signal contacts. The dielectric frame 322 optionally is overmolded over a leadframe, which is optionally stamped and formed to define the receptacle signal contacts 162.

The contact module 160 may include a shield 330 that provides shielding for the receptacle signal contacts 162. In the illustrated embodiment, portions of the shield 330 are positioned between pairs of the receptacle signal contacts 162 to provide shielding between adjacent pairs of the receptacle signal contacts 162. The shield 330 provides electrical shielding between and around respective pairs of the receptacle signal contacts 162. The shield 330 includes the grounding contacts 336 that provide shielding for mating portions 342 of the receptacle signal contacts 162. Optionally, the shield 330 may be a multi-piece shield. For example, the grounding contacts 336 may be separately stamped and formed from grounding bars that are mechanically and electrically connected to the base structure of the shield 330. The grounding contacts 336 may extend along three sides of the pair of receptacle signal contacts 162.

The mating portions 342 extend from the front wall of the dielectric frame 322. The mating portions 342 are configured to be mated with and electrically connected to corresponding header signal contacts 120 (shown in FIGS. 1, 4, 5, 8, and 12). The mating portions 342 within each contact module 160 are arranged in a column. The mating portions 342 define receptacle type mating ends having a receptacle 344 that is configured to receive a pin type contact, for example the header signal contact 120. In the illustrated embodiment, each mating portion 342 is a split beam type of contact having opposed beams 346, 348 defining and flanking the receptacle 344. Other types of mating portions may be provided in other embodiments.

The mating portions 342, the grounding contacts 336, and the second receptacle housing 158 together define the header interface 154. For example, the size and shape of the perimeter of the second receptacle housing 158 as well as the shapes and positions of the mating portions 342 and the grounding contacts 336 define the header interface 154. For example, the mating portions 342 have a predetermined pinout defined by the relative positions of the mating portions 342. Optionally, the pinout may be identical to the pinout defined by the first receptacle connector 104 (shown in FIGS. 1, 2, 11, and 12) such that the receptacle connectors 104 and 106 are interchangeable and configured to be mated to either end 112 or 114 (both shown in FIGS. 1, 4, 5, and 12) of the header transition connector 102.

Optionally, the receptacle signal contacts 162 are arranged as differential pairs. Both receptacle signal contacts 162 of each pair optionally are part of the same contact module 160. The pair of receptacle signal contacts 162 is arranged in the column defined by the contact module 160 and as such the receptacle connector 106 is a pair-in-column receptacle connector 106.

Figure 4:
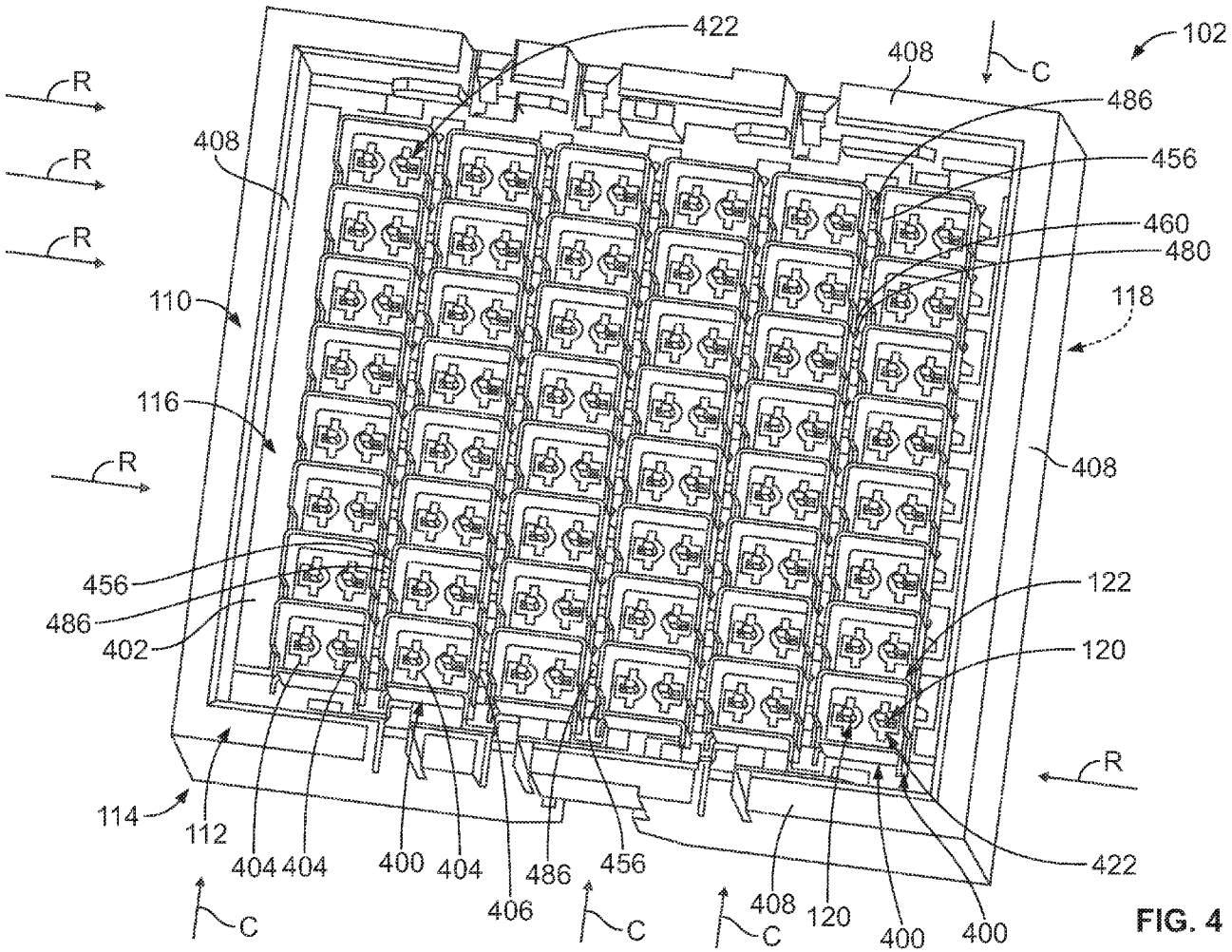
FIG. 4 is a perspective view of an embodiment of a header transition connector of the electrical connector system shown in FIG. 1.
Figure 5:
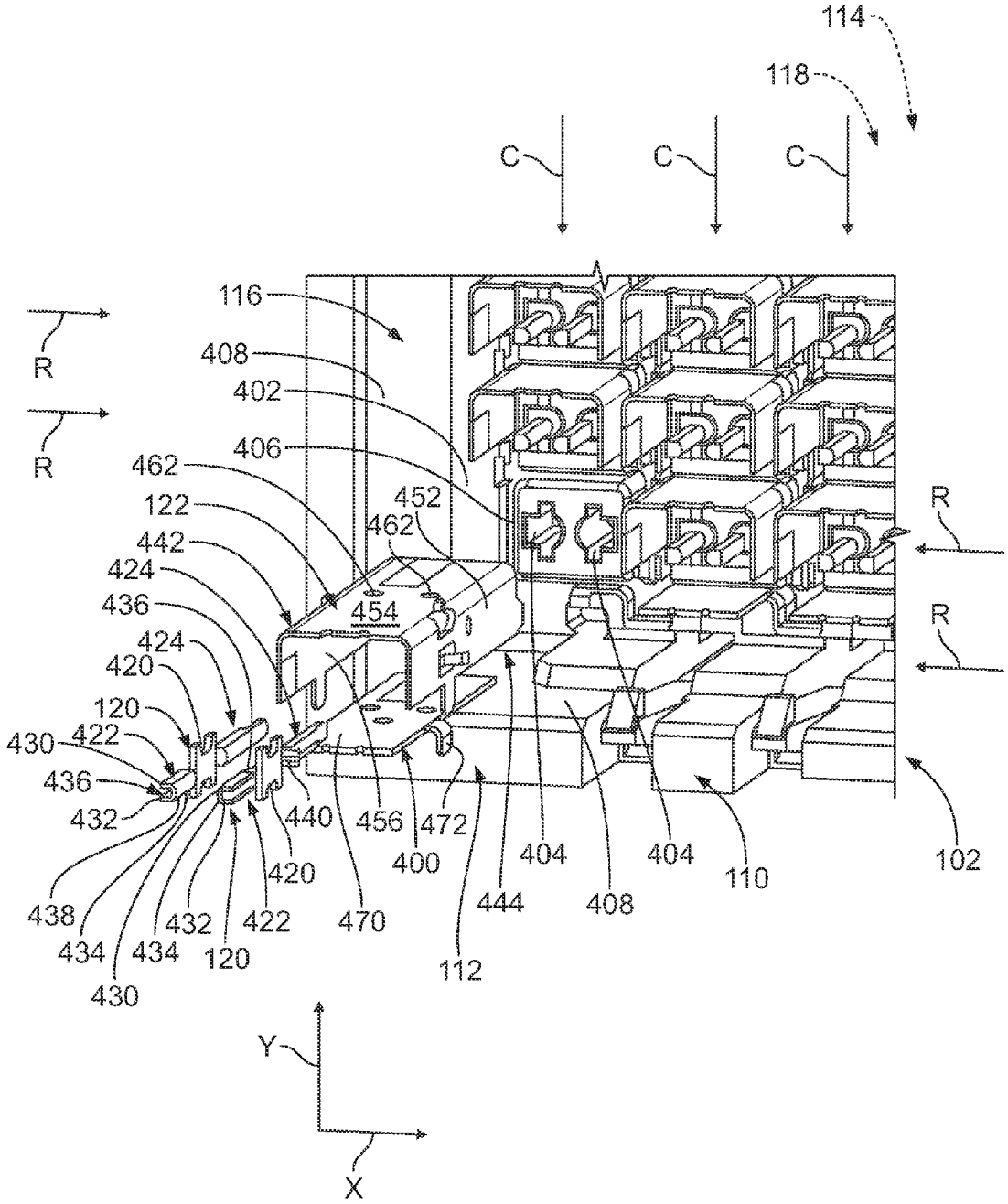
FIG. 5 is an enlarged partially exploded perspective view of the header transition connector shown in FIG. 4.

FIG. 4 is a perspective view of an embodiment of the header transition connector 102. FIG. 5 is an enlarged partially-exploded perspective view of the header transition connector 102. FIG. 5 illustrates a portion of the header transition connector 102 showing an orphan ground shield 400, a pair of the header signal contacts 120 and one of the header ground shields 122 poised for loading into the header housing 110.

Referring now to FIGS. 4 and 5, the header housing 110 of the header transition connector 102 is manufactured from a dielectric material, for example a plastic material. The header housing 110 includes a separating wall 402 between the first cavity 116 and the second cavity 118 (visible in FIG. 1). The separating wall 402 includes signal contact openings 404 that receive corresponding header signal contacts 120 and ground shield openings 406 that receive corresponding header ground shields 122. The signal contact openings 404 are sized and shaped to hold the header signal contacts 120 therein. The ground shield openings 406 are sized and shaped to hold the header ground shields 122 therein.

The header housing 110 includes shroud walls 408 extending from the separating wall 402 to the first end 112 and the second end 114. The shroud walls 408 define the cavities 116 and 118. The shroud walls 408 surround exposed portions of the header signal contacts 120 and the header ground shields 122. The receptacle connectors 104 (shown in FIGS. 1, 2, 11, and 12) and 106 (shown in FIGS. 1, 3, 11, and 12) are configured to be coupled to the shroud walls 408. During mating, the shroud walls 408 may guide the receptacle connectors 104 and 106 into the cavities 116 and 118, respectively, or vice versa.

Referring now solely to FIG. 5, the orphan ground shield 400 is positioned in the corresponding ground shield opening 406 below the bottom-most pair of header signal contacts 120. The orphan ground shield 400 provides shielding below the bottom-most pair of header signal contacts 120. In the illustrated embodiment, the orphan ground shield 400 includes a single planar wall 470; however, the orphan ground shield 400 may include multiple walls in other embodiments.

The orphan ground shield 400 includes one or more optional tabs 472 extending from the wall 470. The tabs 472 are used to stop or locate the orphan ground shield 400 in the corresponding ground shield opening 406, for example to limit the amount that the orphan ground shield 400 is loaded into the corresponding ground shield opening 406. The tabs 472 may define push surfaces for pushing or loading the orphan ground shield 400 into the corresponding ground shield opening 406. Optionally, the first receptacle connector 104 (shown in FIGS. 1, 2, 11, and 12) or the second receptacle connector 106 (shown in FIGS. 1, 3, 11, and 12) may be positioned immediately behind the tabs 472 within the cavity 116 or within the cavity 118 to block the orphan ground shield 400 from being pushed out of the corresponding ground shield opening 406, for example when the other receptacle connector 104 or 106 is loaded into the other cavity 116 or 118.

Although the wall 470 is shown as an integrally formed single, unitary structure, alternatively the wall 470 is formed from two or more separately (i.e., discretely) formed structures.

Optionally, the header signal contacts 120 are substantially similar to each other. Each header signal contact 120 includes a base section 420, which may be approximately centered along a length of the header signal contact 120. Optionally, the header signal contact 120 is a stamped and formed contact. The base section 420 is configured to be received in the corresponding signal contact opening 404 and held therein, such as by an interference fit.

The header signal contact 120 includes a first mating end 422 extending from one side of the base section 420 and a second mating end 424 extending from the opposite side of the base section 420. The first mating end 422 is configured to extend into the first cavity 116 for mating with a respective signal contact 142 (FIG. 2) of the first receptacle connector 104. The second mating end 424 is configured to extend into the second cavity 118 for mating with a respective signal contact 162 (FIG. 3) of the second receptacle connector 106. In the illustrated embodiment, each of the mating ends 422 and 424 defines a pin type contact having a generally equal width and height (defined in the X and Y directions, respectively).

In the illustrated embodiment, each of the mating ends 422 and 424 is formed into a U-shaped pin. For example, with reference to the first mating end 422 (the second mating end 424 may be formed in a similar manner), the pin is formed by bending or rolling an upper shoulder 430 and a lower shoulder 432 with a connecting segment 434 therebetween. The connecting segment 434 may be curved. In the illustrated embodiment, the upper and lower shoulders 430 and 432, respectively, are generally planar and parallel to one another with a gap 436 therebetween. In other embodiments, the shoulders 430 and 432 may be curved and distal ends of the upper and lower shoulder may abut one another, for example to form a round or O-shaped pin rather than the U-shaped pin shown in the illustrated embodiment. Optionally, a tip 438 is formed at the distal end of the first mating end 422. The tip 438 reduces stubbing with the receptacle signal contact 142 during mating.

The upper and lower shoulders 430 and 432, respectively, may be compressible toward one another. For example, the shoulders 430 and 432 may be resiliently deflected by the beams 246 and 248 (shown in FIG. 2) of the corresponding receptacle signal contact 142 (shown in FIG. 2) when received in the receptacle 244 (shown in FIG. 2) thereof. The upper shoulder 430 defines an upward facing mating interface for mating with the upper beam 246 of the receptacle signal contact 142. The lower shoulder 432 defines a downward facing mating interface for mating with the lower beam 248 of the receptacle signal contact 142. The upper shoulder 430 and the lower shoulder 432 are both perpendicular to the base section 420.

In the illustrated embodiment, the upper shoulder 430 and the lower shoulder 432 are parallel to corresponding upper and lower shoulders 430 and 432, respectively, of the second mating end 424. Optionally, the upper shoulder 430 and the lower shoulder 432 are coplanar with the upper and lower shoulders 430 and 432, respectively, of the second mating end 424. Optionally, the shoulders 430 and 432 of the second mating end 424 include ramps 440 extending therefrom that are used to control impedance, for example when the second receptacle connector 106 is not fully mated.

In the illustrated embodiment of the header signal contacts 120, the various structures of each of the header signal contacts 120 are integrally formed as a single, unitary structure. Alternatively, one or more of the various structures of a header signal contact 120 (e.g., the first mating end 422, the second mating end 424, and/or the base section 420) is separately (i.e., discretely) formed as a separate (i.e., discrete) structure from one or more other structures of the header signal contact 120.

Figure 6:
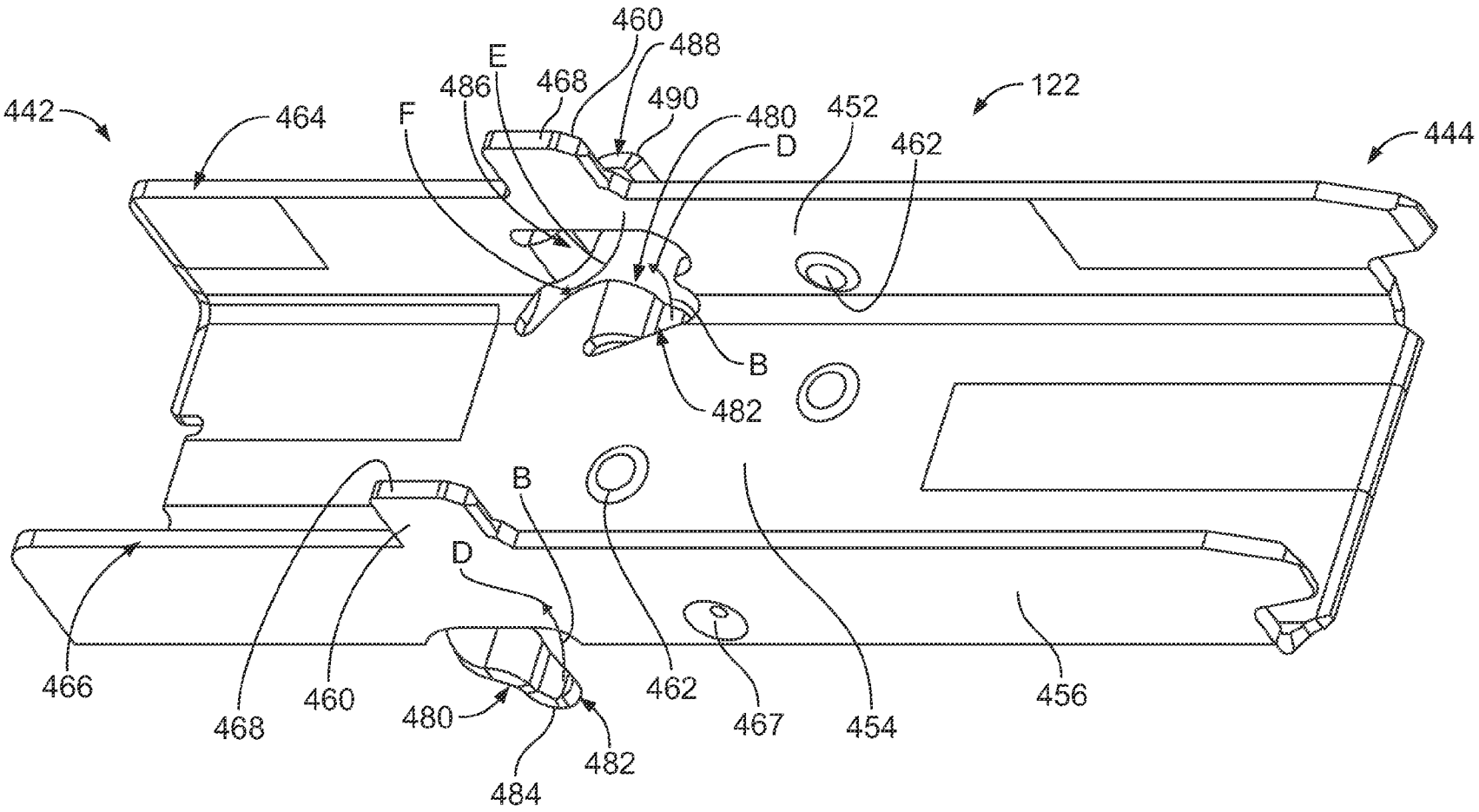
FIG. 6 is a perspective view of an embodiment of a header ground shield of the header transition connector shown in FIGS. 4 and 5.
Figure 7:
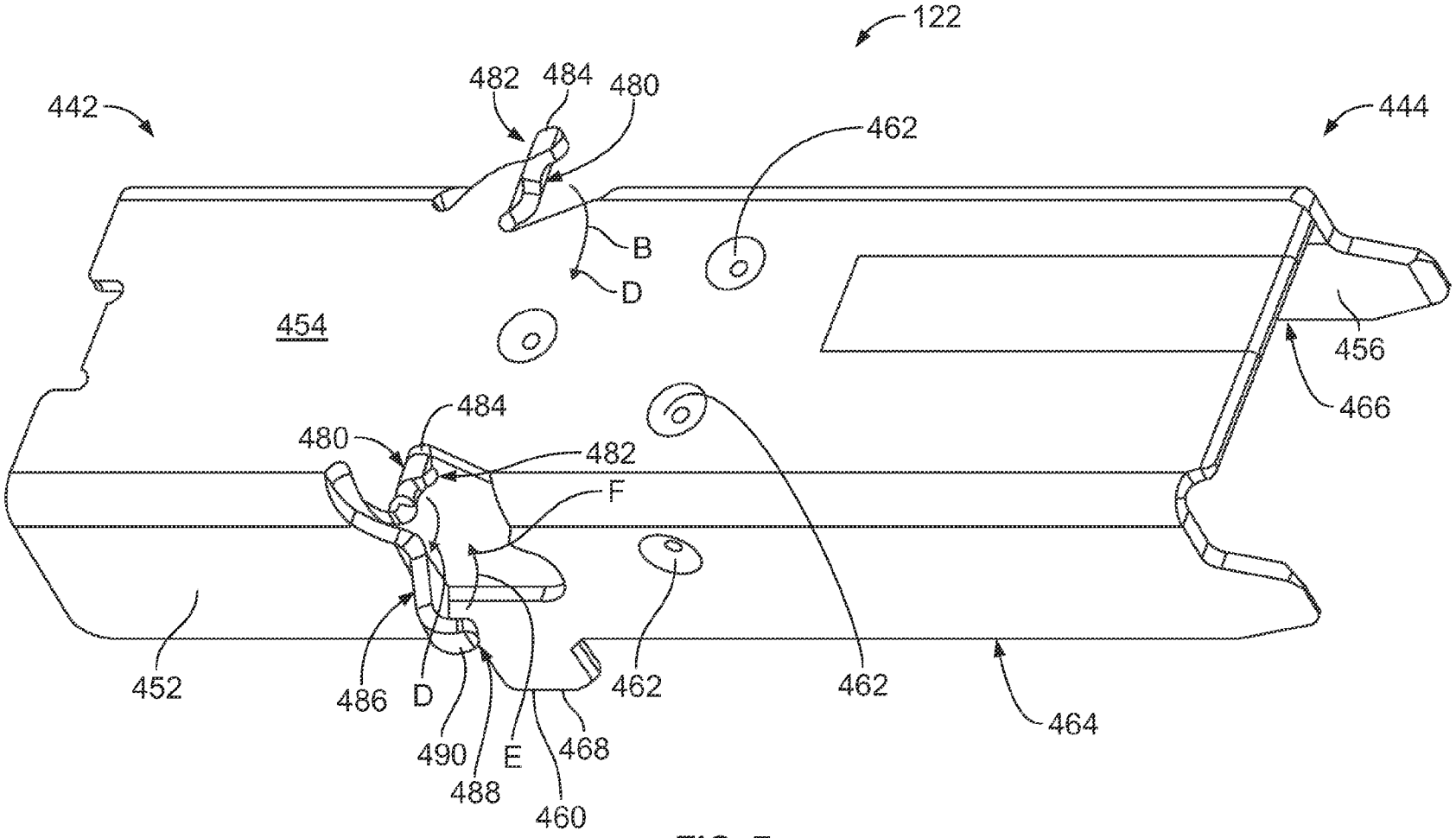
FIG. 7 is another perspective view of the header ground shield shown in FIG. 6 viewed in a different orientation as compared to FIG. 6.

FIG. 6 is a perspective view of an embodiment of one of the header ground shields 122. FIG. 7 is another perspective view of the header ground shield 122 viewed in a different orientation as compared to FIG. 6. Optionally, the header ground shields 122 are substantially similar.

Referring now to FIGS. 5-7, the header ground shields 122 are sized and shaped to provide electrical shielding around the pair of header signal contacts 120 (not shown in FIGS. 6 and 7). The header ground shields 122 each include a first mating end 442 and an opposite second mating end 444. The first mating end 442 is configured to extend into the first cavity 116 (not shown in FIGS. 6 and 7) for mating with the grounding contacts 236 (shown in FIG. 2) of the first receptacle connector 104 (shown in FIGS. 1, 2, 11, and 12), while the second mating end 444 is configured to extend into the second cavity 118 (shown in FIGS. 1, 4, 5, and 12) for mating with the grounding contacts 336 (shown in FIG. 3) of the second receptacle connector 106 (shown in FIGS. 1, 3, 11, and 12), or vice versa.

In the illustrated embodiment, the header ground shields 122 are C-shaped and provide shielding on three sides of the pair of header signal contacts 120. The header ground shields 122 have a plurality of walls in the illustrated embodiment, namely three planar walls 452, 454, 456. The walls 452, 454, 456 may be integrally formed as a single, unitary structure, or alternatively, one or more of the walls 452, 454, and/or 456 may be a separately (i.e., discretely) formed structure. The wall 454 defines a base wall or top wall of the header ground shield 122. The walls 452 and 456 define side walls that extend from the base wall 454. The side walls 452 and/or 456 are optionally generally perpendicular to the base wall 454, as is shown in the illustrated embodiment (other angles such as oblique angles may be provided in other embodiments). In the illustrated embodiment, the bottom of each header ground shield 122 is open between the side walls 452 and 456. Either the header ground shield 122 associated with another pair of header signal contacts 120 or the orphan ground shield 400 (not shown in FIGS. 6 and 8) provides shielding along the open, fourth side such that each of the pairs of header signal contacts 120 is shielded from each adjacent pair in the same column C (described below; not shown in FIGS. 6 and 7) and the same row R (described below; not shown in FIGS. 6 and 7).

The header ground shields 122 may be provided with other configurations, sizes, shapes, and/or the like in other embodiments. The header ground shields 122 may be provided with more or less (i.e., any number of) walls in other embodiments. The walls of the header ground shield 122 may be bent or angled rather than being planar. In some other embodiments, the header ground shields 122 may provide shielding for individual header signal contacts 120 or sets of contacts having more than two header signal contacts 120.

The header ground shield 122 includes one or more interference bumps 462 formed in the walls 452, 454, and/or 456. The interference bumps 462 engage the header housing 110 (not shown in FIGS. 6 and 7), such as inside the ground shield opening 406 (not shown in FIGS. 6 and 7), to hold the header ground shield 122 in the ground shield opening 406 by an interference fit.

In the illustrated embodiment of the header ground shields 122, the various structures (e.g., the first mating end 442, the second mating end 444, the side wall 452, the base wall 454, and/or the side wall 456) of each of the header ground shields 122 are integrally formed as a single, unitary structure. Alternatively, one or more of the various structures of a header ground shield 122 is separately (i.e., discretely) formed as a separate (i.e., discrete) structure from one or more other structures of the header ground shield 122.

Figure 8:
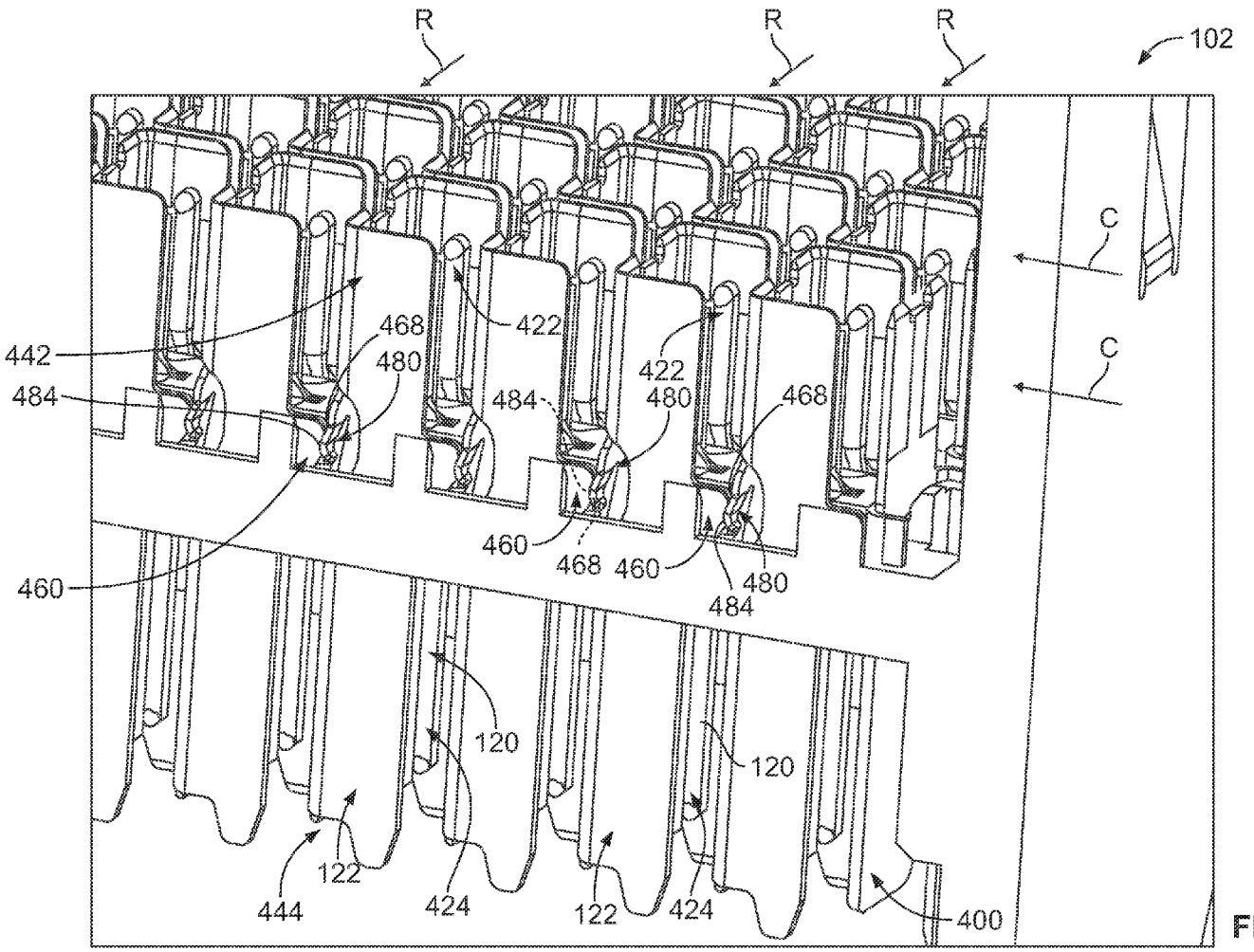
FIG. 8 is a perspective view of the header transition connector shown in FIGS. 4 and 5 illustrating a cross section of the header transition connector.

FIG. 8 is a perspective view of the header transition connector 102 illustrating a cross section of the header transition connector 102. The header ground shields 122 optionally extend an entire length of the header signal contacts 120 from the tip of the first mating end 422 to the tip of the second mating end 424, as is shown in FIG. 8. Optionally, because the first receptacle connector 104 (shown in FIGS. 1, 2, 11, and 12) or the second receptacle connector 106 (shown in FIGS. 1, 2, 11, and 12) is securely coupled to the header transition connector 102 as a header assembly 500 (shown in and described below with respect to FIG. 12), the first mating ends 422 of the header signal contacts 120 and the first mating ends 442 of the header ground shields 122 do not have the same mating and unmating requirements and built-in tolerances as the second mating ends 424 and 444. As such, the first mating ends 422 of the header signal contacts 120 may be shorter than the second mating ends 424 of the header signal contacts 120, and the first mating ends 442 of the header ground shields 122 may be shorter than the second mating ends 444 of the header ground shields 122, which may result in a reduction in the amount of materials used to manufacture (i.e., fabricate) the electrical connector system 100 (shown in FIGS. 1, 11, and 12). The amount of plating (e.g., gold plating) may be reduced. The amount of electrical stub may be reduced.

Referring again to FIG. 4, in the illustrated embodiment, the first mating ends 422 of the header signal contacts 120 are arranged within the cavity 116 in an array of the rows R and the columns C. In the illustrated embodiment, the header signal contacts 120 within each pair are arranged in the same column C. The second mating ends 424 (FIG. 5) of the header signal contacts 120 are arranged within the cavity 118 (shown in FIGS. 1, 4, 5, and 12) in an array of the rows R and the columns C in a substantially similar (e.g., identical, matching, mirrored, and/or the like) manner to the arrangement described above and illustrated in FIG. 4 with respect to the first mating ends 422.

In the illustrated embodiment, the first mating ends 442 (FIG. 5) of the header ground shields 122 are arranged within the cavity 116 in an array of the rows R and the columns C. The second mating ends 444 of the header ground shields 122 are arranged within the cavity 118 in an array of the rows R and the columns C in a substantially similar (e.g., identical, matching, mirrored, and/or the like) manner to the arrangement described above and illustrated in FIG. 4 with respect to the first mating ends 442.

Although ten rows R are shown, the header transition connector 102 may include any number of the rows R to correspond with the number of rows of the first and second receptacle connectors 104 and 106 (FIG. 1). Although six columns C are shown, the header transition connector 102 may include any number of the columns C to correspond with the number of columns of the first and second receptacle connectors 104 and 106 (FIG. 1). Each of the rows R may be referred to herein as a "first" and/or an "other" row. Each of the columns C may be referred to herein as a "first" and/or an "other" column.

Referring again to FIGS. 6 and 7, the header ground shield 122 optionally includes one or more spring arms 480. Each spring arm 480 is configured to engage in physical contact with an adjacent header ground shield 122 within the same column C (FIG. 4) to electrically common the two adjacent header ground shields 122 within the column C. In the illustrated embodiment, each spring arm 480 extends outward from the base wall 454. Each spring arm 480 extends outward to an end 482 having an engagement surface 484. Each spring arm 480 is configured to engage in physical contact with the adjacent header ground shield 122 within the same column C at the engagement surface 484.

In the illustrated embodiment, the end 482 of each spring arm 480 is resiliently deflectable along an arc B in the direction D from the natural resting position of the spring arm 480 shown in FIGS. 6 and 7. The resilience of the spring arm 480 (i.e., the bias of the end 482 of the spring arm 480 to the natural resting position thereof) generates an engagement force between the engagement surface 484 and the adjacent header ground shield 122 within the same column C to provide a reliable engagement and thus electrical connection between the two header ground shields 122.

Although two spring arms 480 are shown, each header ground shield 122 may include any number of the spring arms 480 for engaging in physical contact with any number of other header ground shields 122. Moreover, each spring arm 480 may alternatively have any other location(s) along the header ground shield 122 than the locations shown herein.

The header ground shield 122 optionally includes one or more tabs 460. Each tab 460 is configured to engage in physical contact with the spring arm 480 of an adjacent header ground shield 122 within the same column C to electrically common the two adjacent header ground shields 122 within the column C. In the illustrated embodiment, each tab 460 extends outward from a corresponding side wall 452 or 456 at a respective end 464 or 466 thereof. Each tab 460 extends outward to an engagement surface 468. Each tab 460 is configured to engage in physical contact with the spring arm 480 of the adjacent header ground shield 122 within the same column C at the engagement surface 468. The ends 464 and 466 of the side walls 452 and 456 include the engagement surface 468 of the corresponding tab 460.

Although two tabs 460 are shown, each header ground shield 122 may include any number of the tabs 460 for engaging in physical contact with any number of locations on other header ground shields 122. Moreover, each tab 460 may additionally or alternatively have any other location(s) along the header ground shield 122 than the locations shown herein.

Optionally, the tabs 460 are used to stop or locate the header ground shield 122 in the ground shield opening 406 (shown in FIGS. 4 and 5), for example to limit the amount that the header ground shield 122 is loaded into the ground shield opening 406. The tabs 460 may define push surfaces for pushing or loading the header ground shield 122 into the ground shield opening 406. Optionally, the first receptacle connector 104 (shown in FIGS. 1, 2, 11, and 12) or the second receptacle connector 106 (shown in FIGS. 1, 3, 11, and 12) may be positioned immediately behind the tabs 460 when loaded into the first cavity 116 (shown in FIGS. 1, 4, 5, 11, and 12) to block the header ground shield 122 from being pushed out of the ground shield opening 406, for example when the other receptacle connector 104 or 106 is loaded into the second cavity 118 (shown in FIGS. 1, 4, 5, and 12).

Optionally, the header ground shield 122 includes one or more spring arms 486 configured to engage in physical contact with an adjacent header ground shield 122 within the same row R (FIG. 4) to electrically common the two adjacent header ground shields 122 within the row R. In the illustrated embodiment, the spring arm 486 extends outward from the first side wall 452. The spring arm 486 extends outward to an end 488 having an engagement surface 490. The spring arm 486 is configured to engage in physical contact with the adjacent header ground shield 122 within the same row R at the engagement surface 490.

In the illustrated embodiment, the end 488 of each spring arm 486 is resiliently deflectable along an arc E in the direction F from the natural resting position of the spring arm 486 shown in FIGS. 6 and 7. The resilience of the spring arm 486 (i.e., the bias of the end 488 of the spring arm 486 to the natural resting position thereof) generates an engagement force between the engagement surface 490 and the adjacent header ground shield 122 within the same row R to provide a reliable engagement and thus electrical connection between the two header ground shields 122.

Each header ground shield 122 may include any number of the spring arms 486 for engaging in physical contact with one or more other header ground shields 122. In the illustrated embodiment, the header ground shield 122 includes only a single spring arm 486. The spring arm 486 may alternatively have any other location(s) along the header ground shield 122 than the location shown herein.

In some other embodiments, the header ground shield 122 does not include any of the spring arms 486 such that the header ground shield 122 is not configured to be engaged in physical contact (and thus not electrically commoned with) adjacent header ground shields 122 within the same row R. Moreover, in some other embodiments, the header ground shield 122 does not include any of the spring arms 480 such that the header ground shield 122 is not configured to be engaged in physical contact (and thus not electrically commoned with) adjacent header ground shields 122 within the same column C.

Referring again to FIG. 4, at least some of the header ground shields 122 are electrically commoned with each other within the header housing 110 of the header transition connector 102. For example, a group of the header ground shields 122 may be electrically commoned with each other within the header housing 110. Electrically commoning at least some of the header ground shields 122 within the header housing 110 may provide an electrical connector system 100 that mates the receptacle connectors 104 and 106 together without a midplane circuit board but that behaves electrically as if a midplane circuit board is present. Electrically commoning at least some of the header ground shields 122 within the header housing 110 may enable the header transition connector 102 to cancel and/or reduce signal noise, to improve inter-pair signal skew, to match and/or provide a predetermined impedance, and/or the like. The header ground shields 122 within the group are electrically commoned within the header housing 110 via engagement of the header ground shields 122 so as to provide a continuous electrical pathway from any one header ground shield 122 of the group to all other header ground shields 122 of the group, as will be specifically described below with respect to the illustrated embodiment.

The group of the header ground shields 122 that are electrically commoned may include any number of the overall number of header ground shields 122. In some embodiments, the group of the header ground shields 122 that are electrically commoned includes all of the header ground shields 122 of the header transition connector 102. Moreover, any particular header ground shields 122 may be included within the group of header ground shields 122 that are electrically commoned within the header housing 110. The number of and particular header ground shields 122 within the group of electrically commoned header ground shields 122, as well as the pattern, configuration, relative arrangement, and/or the like of the group of electrically commoned header ground shields 122, may be selected to provide the header transition connector 102 with a predetermined electrical performance (e.g., to cancel and/or reduce signal noise, to improve signal skew, to match and/or provide a predetermined impedance, and/or the like)

Figure 9:
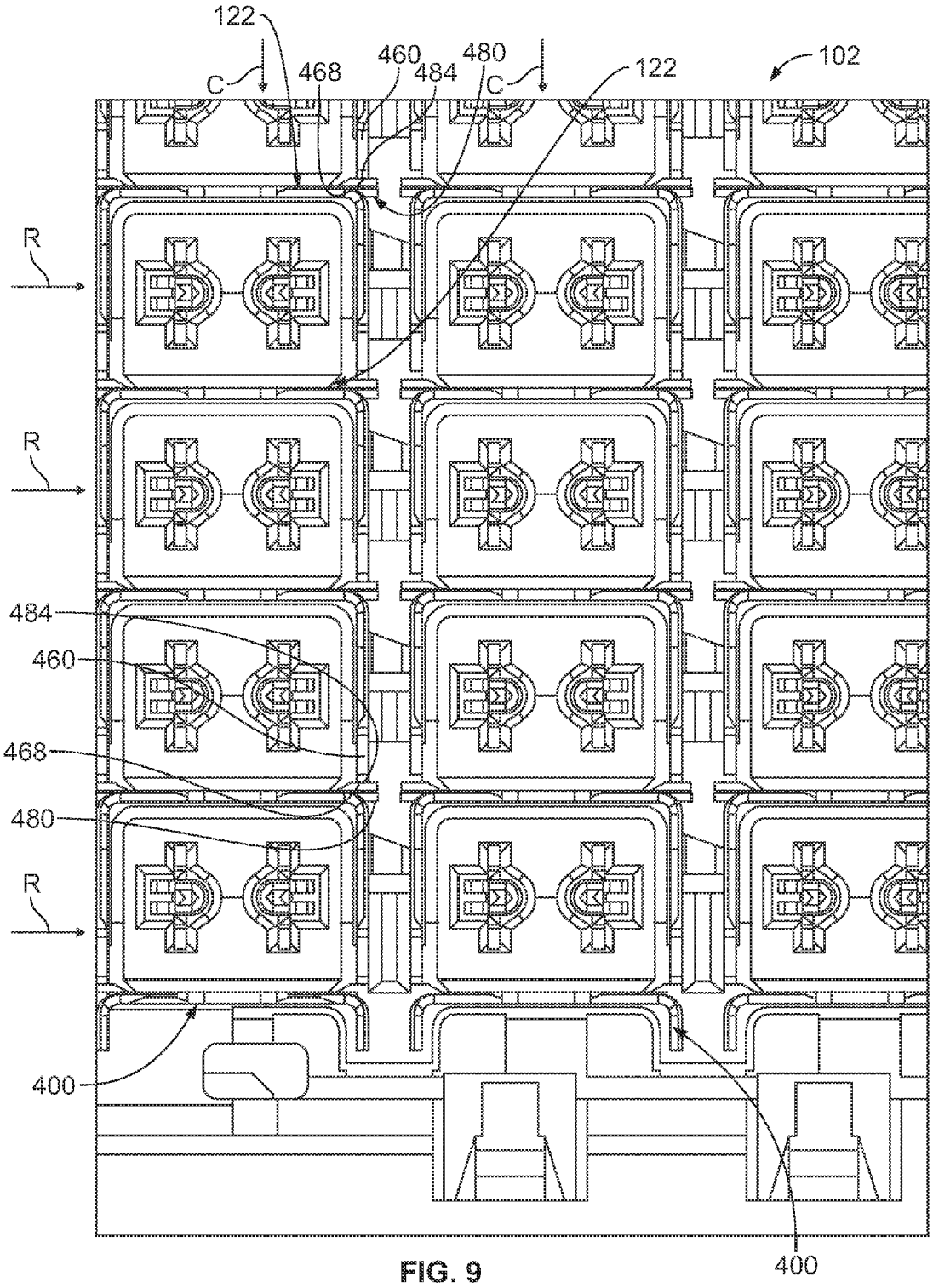
FIG. 9 is an elevational view of a portion of the header transition connector shown in FIGS. 4, 5, and 8.
Figure 10:
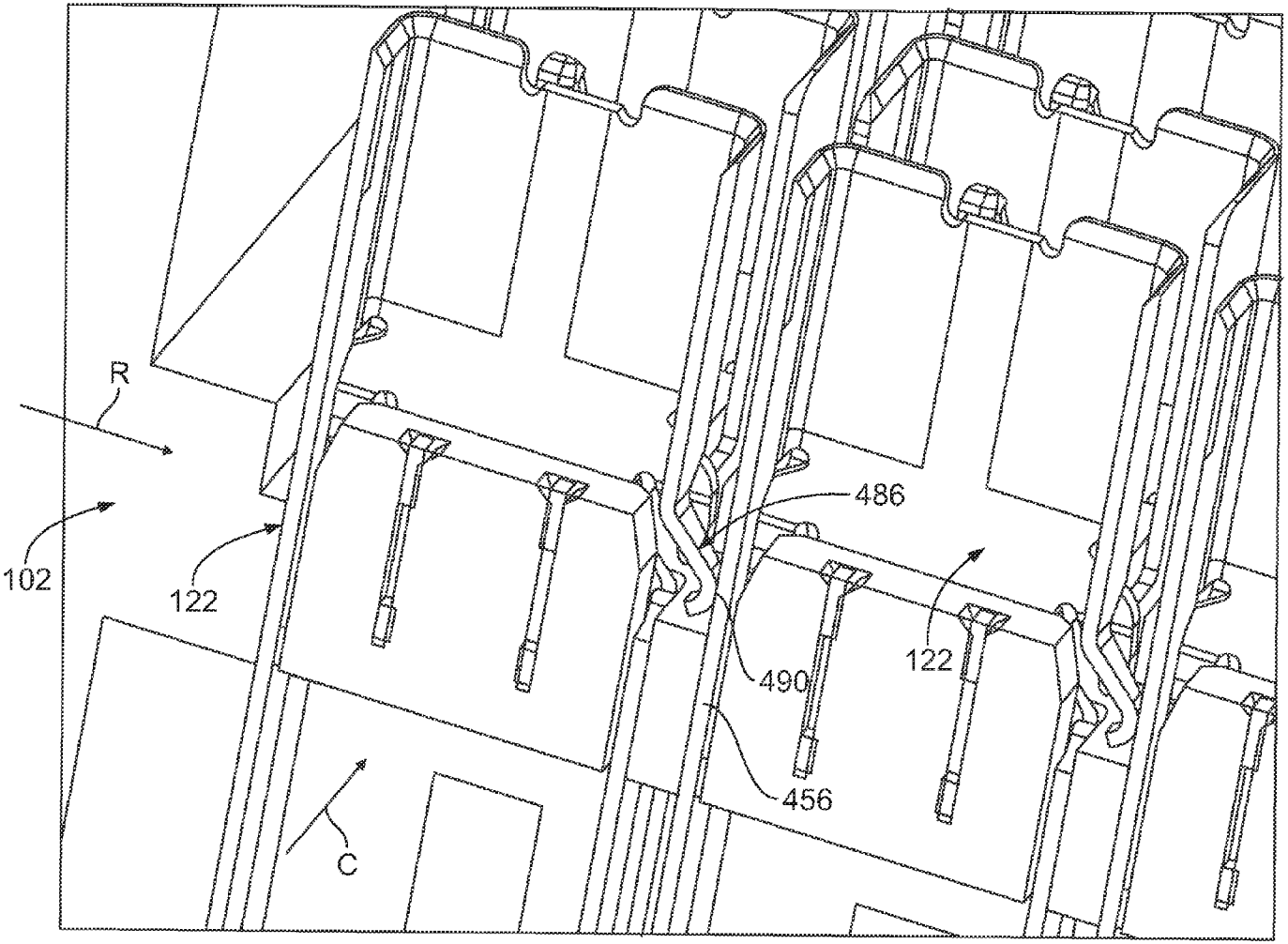
FIG. 10 is a perspective view of the header transition connector shown in FIGS. 4, 5, 8, and 9 illustrating another cross section of the header transition connector.

FIG. 9 is an elevational view of a portion of the header transition connector 102. Referring now to FIGS. 4, 8, and 9, in the illustrated embodiment, within each column C, the spring arms 480 of the header ground shields 122 are engaged in physical contact with the tabs 460 of adjacent header ground shields 122 within the same column C. Specifically, and referring now solely to FIGS. 8 and 9, within each column C, the engagement surfaces 484 of the spring arms 480 are engaged in physical contact with the engagement surfaces 468 of the corresponding tabs 460 of adjacent header ground shields 122 within the same column C. The engagement in physical contact of the engagement surfaces 484 and 468 electrically connects adjacent header ground shields 122 within the same column C such that at least some of the header ground shields 122 within the column C are electrically commoned together.

Referring again to FIG. 4, any number, and any particular ones, of the header ground shields 122 within each column C may be electrically commoned. In the illustrated embodiment, all of the header ground shields 122 within each column C (excepting the orphan ground shields 400) are electrically commoned. In some other embodiments, the orphan ground shield 400 of one or more columns C is electrically commoned with one or more other header ground shields 122 of the same column C, for example using a similar structure to the spring arms 480 and/or the tabs 460 and/or using another structure.

Any number, and any particular ones, of the columns C may include header ground shields 122 that are electrically commoned. In the illustrated embodiment, all of the columns C include header ground shields 122 that are electrically commoned.

In the illustrated embodiment, within each row R, the spring arms 486 of the header ground shields 122 are engaged in physical contact with the side walls 456 of adjacent header ground shields 122 within the same row R. Specifically, and referring now to FIG. 10, within each row R, the engagement surfaces 490 of the springs arms 486 are engaged in physical contact with the side walls 456 of adjacent header ground shields 122 within the same row R. The engagement in physical contact of the spring arms 486 and the side walls 456 electrically connects adjacent header ground shields 122 within the same row R such that at least some of the header ground shields 122 within the row R are electrically commoned.

Referring again to FIG. 4, any number, and any particular ones, of the header ground shields 122 within each row R may be electrically commoned. In the illustrated embodiment, all of the header ground shields 122 within each row R are electrically commoned. Any number, and any particular ones, of the rows R may include header ground shields 122 that are electrically commoned. In the illustrated embodiment, all of the rows R include header ground shields 122 that are electrically commoned. In some other embodiments, two or more of the orphan ground shields 400 within the row R of the orphan ground shields 400 are electrically commoned, for example using a similar structure to the spring arms 486 and/or using another structure.

Although the illustrated embodiment includes both header ground shields 122 electrically commoned within the same column C and header ground shields 122 electrically commoned within the same row R, the header transition connector 102 is not limited thereto. For example, in some other embodiments, the header transition connector 102 only includes electrically-commoned header ground shields 122 within one or more columns C (i.e., does not include any header ground shields 122 that are electrically commoned with one or more other header ground shields 122 within the same row R). Electrically commoning the header ground shields 122 only within the columns C may provide the header transition connector 102 with a substantially similar electrical performance as compared with also electrically commoning header ground shields 122 within the same row(s) R. In other words, electrically commoning the header ground shields 122 within the rows R may not provide a noticeable, substantial, and/or more than trivial improvement in the electrical performance of the header transition connector 102.

Figure 11:
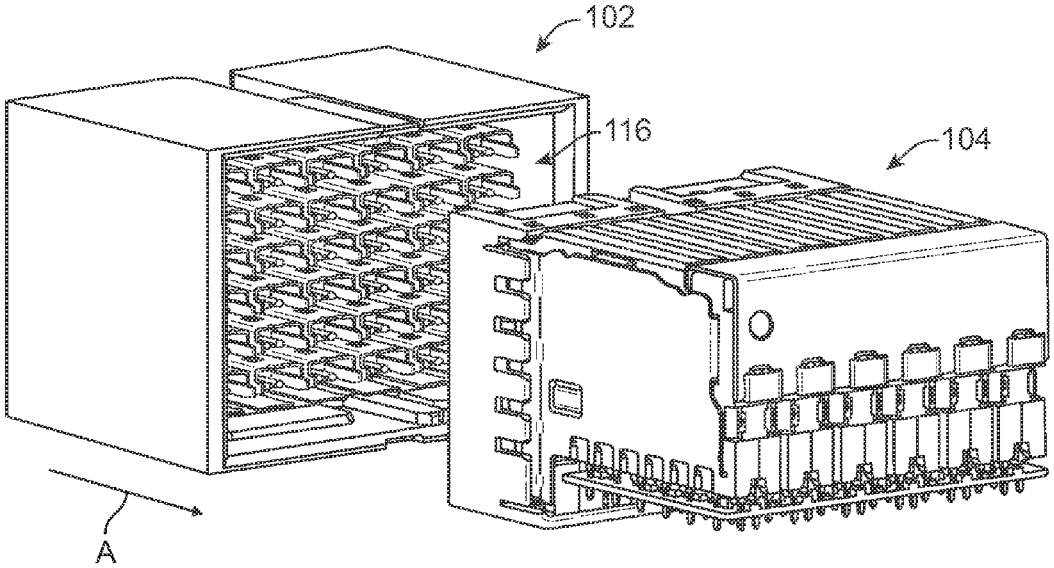
FIG. 11 illustrates the header transition connector shown in FIGS. 4, 5, and 8-10 poised for mating with the first receptacle connector shown in FIG. 2.

FIG. 11 illustrates the header transition connector 102 poised for mating with the first receptacle connector 104. The header transition connector 102 is loaded in a loading direction A. The first receptacle connector 104 is configured to be received in the first cavity 116. Optionally, securing features may be provided to securely couple the header transition connector 102 to the first receptacle connector 104. Guide features may be provided to guide mating.

Figure 12:
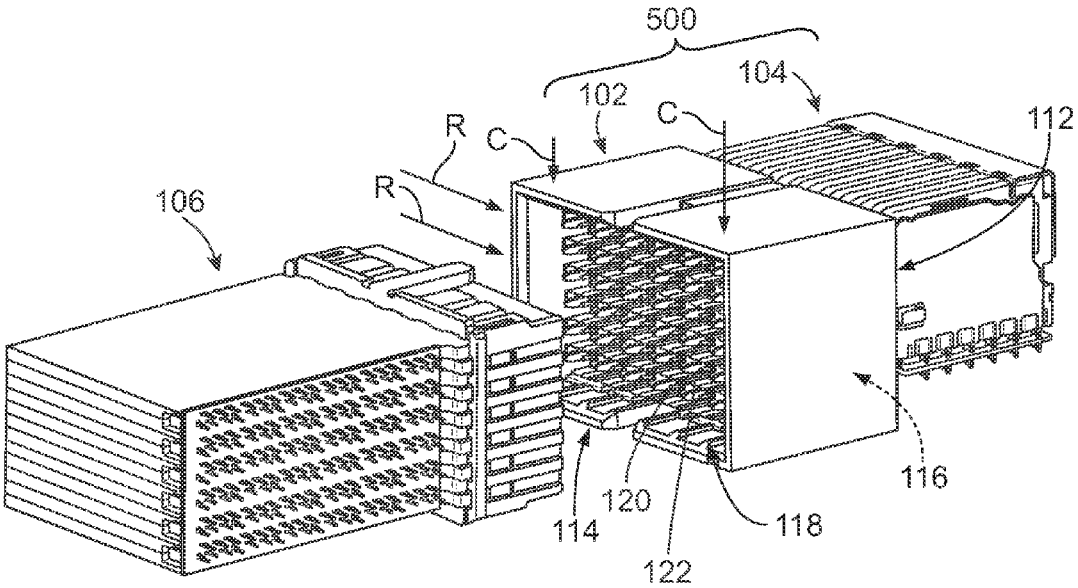
FIG. 12 is a front perspective view of the header transition connector shown in FIGS. 4, 5, and 8-10 coupled to the first receptacle connector shown in FIG. 2 to form a header assembly.

FIG. 12 is a front perspective view of the header transition connector 102 coupled to the first receptacle connector 104 to form the header assembly 500. The header signal contacts 120 are arranged in an array in the rows R and columns C having a pinout that is complementary to the pinout of the receptacle signal contacts 142 (shown in FIGS. 1 and 2) and 162 (shown in FIGS. 1 and 3) of the first and second receptacle connectors 104 (shown in FIGS. 1, 2, 11, and 12) and 106 (shown in FIGS. 1, 3, 11, and 12), respectively. For example, the pinouts are defined by the horizontal and vertical spacings between the corresponding signal contacts 120, 142, and 162 (for example, the centerline spacings) and the horizontal and vertical spacings from the signal contacts 120, 142, and 162 to the header ground shields 122 (for example, the centerline spacings). Optionally, the pinouts of the header transition connector 102 are complementary, matching, identical, and/or the like to the pinouts of the receptacle connectors 104 and 106 to allow mating and interchangeability of the receptacle connectors 104 and 106 into either cavity 116 or 118 of the header transition connector 102. In other words, the pinouts of the header transition connector 102 may be configured relative to the pinouts defined by the receptacle connectors 104 and 106 such that the receptacle connectors 104 and 106 are interchangeable and configured to be mated to either end 112 or 114 of the header transition connector 102.

In an exemplary embodiment, the header transition connector 102 is coupled to the first receptacle connector 104 prior to mating with the second receptacle connector 106. Optionally, the header assembly 500 may form part of an electrical system, such as, but not limited to, a backplane, a network switch, a computer server, and/or the like, where many header assemblies 500 are arranged together, such as, but not limited to, inside a chassis, rack, and/or the like. One or more second receptacle connectors 106 may be coupled to the header assemblies 500 as part of line and/or switch cards. The header transition connector 102, by being coupled directly to the first receptacle connector 104, enables mating of the second receptacle connector 106 to the first receptacle connector 104 without the need for a midplane circuit board, and vice versa. The header transition connector 102 changes the mating interface of the first receptacle connector 104 from a receptacle interface to a pin interface for mating with the second receptacle connector 106, and vice versa.

The embodiments described and/or illustrated herein may provide an improved electrical connector system for mating receptacle connectors without a midplane circuit board.

For example, the embodiments described and/or illustrated herein may provide an electrical connector system that mates receptacle connectors together without a midplane circuit board but that behaves electrically (e.g., from a signal integrity perspective) as if a midplane circuit board is present. Moreover, and for example, the embodiments described and/or illustrated herein may cancel signal noise generated when passing an array of signals between receptacle connectors without a midplane circuit board. The embodiments described and/or illustrated herein may provide an electrical connector system having reduced signal noise as compared to at least some known electrical connector systems that mate receptacle connectors together without a midplane circuit board, for example. Moreover, and for example, the embodiments described and/or illustrated herein may improve inter-pair signal skew when passing an array of signals between receptacle connectors without a midplane circuit board, for example. The embodiments described and/or illustrated herein may provide an electrical connector system having improved signal skew as compared to at least some known electrical connector systems that mate receptacle connectors together without a midplane circuit board, for example.

The embodiments described and/or illustrated herein may provide an electrical connector system having improved signal skew as compared to at least some known electrical connector systems that mate receptacle connectors together with a midplane circuit board.

The embodiments described and/or illustrated herein may provide an electrical connector system having a reduced cost and/or a reduced size as compared to at least some known electrical connector systems for mating receptacle connectors. For example, the embodiments described and/or illustrated herein may provide an electrical connector system that has a reduced cost as compared to at least some known electrical connector systems that mate receptacle connectors together with a midplane circuit board and/or as compared to at least some known electrical connector systems that mate receptacle connectors together without a midplane circuit board. Moreover, and for example, the embodiments described and/or illustrated herein may provide an electrical connector system that mates receptacle connectors together without a midplane circuit board with: (1) a reduced cost as compared to at least some known electrical connector systems that mate receptacle connectors together with a midplane circuit board; and (2) the electrical performance of a midplane circuit board.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A header transition connector comprising:

a header housing having a separating wall separating a first cavity from a second cavity;

header signal contacts held by the header housing, the header signal contacts arranged in pairs carrying differential signals, the header signal contacts having first mating ends in the first cavity for mating with a first receptacle connector, the header signal contacts having second mating ends in the second cavity for mating with a second receptacle connector; and header ground shields held by the header housing, the header ground shields having walls surrounding associated pairs of header signal contacts on at least two sides thereof, the header ground shields having first mating ends in the first cavity for mating with the first receptacle connector, the header ground shields having second mating ends in the second cavity for mating with the second receptacle connector, the header ground shield comprising an engagement feature integral with the corresponding header ground shield, the engagement feature having an engagement surface, wherein at least a group of the header ground shields are electrically commoned via engagement of the engagement feature in physical contact at the engagement surface with at least one other header ground shield of the group within the header housing.

2. The header transition connector of claim 1, wherein the header ground shields are arranged in an array of rows and columns, the group of header ground shields comprising header ground shields within a first column of the columns.

3. The header transition connector of claim 1, wherein the header ground shields are arranged in an array of rows and columns, the group of header ground shields comprising header ground shields within a first row of the rows.

4. The header transition connector of claim 1, wherein the header ground shields are arranged in an array of rows and columns, the group of header ground shields comprising header ground shields within a first column of the columns, at least some of the header ground shields of each other column being electrically commoned with at least some of the other header ground shields of the same column.

5. The header transition connector of claim 1, wherein the header ground shields are arranged in an array of rows and columns, the group of header ground shields comprising header ground shields within a first column of the columns, at least some of the header ground shields of each other column being electrically commoned with at least some of the other header ground shields of the same column, at least some of the header ground shields of each row being electrically commoned with at least some of the other header ground shields of the same row.

6. The header transition connector of claim 1, wherein the header ground shields are arranged in an array of rows and columns, the group of header ground shields comprising header ground shields within a first column of the columns, the header ground shields of the group being electrically commoned with each other via engagement in physical contact with another header ground shield of the group that is adjacent within the first column.

7. The header transition connector of claim 1, wherein the engagement feature is a spring arm that is engaged in physical contact with another header ground shield of the group to electrically common the header ground shields of the group.

8. The header transition connector of claim 1, wherein the engagement feature is a tab that is engaged in physical contact with another header ground shield of the group to electrically common the header ground shields of the group.

9. The header transition connector of claim 1, wherein the walls of the header ground shields comprise base walls and side walls that extend from the base walls, the engagement feature extends from the base wall and is engaged in physical contact with an end of a side wall of another header ground shield of the group to electrically common the header ground shields of the group.

10. The header transition connector of claim 1, wherein the header ground shields are C-shaped.

11. The header transition connector of claim 1, wherein the walls of the header ground shield comprise a base wall and a side wall that extends from the base wall, the base wall spanning across both header signal contacts of the corresponding pair of header signal contacts.

12. The header transition connector of claim 1, wherein the header ground shield is a stamped and formed structure, the engagement feature is formed from the header ground shield.

13. A header transition connector comprising:

a header housing having a separating wall separating a first cavity from a second cavity;

header signal contacts held by the header housing, the header signal contacts arranged in pairs carrying differential signals, the header signal contacts having first mating ends in the first cavity for mating with a first receptacle connector, the header signal contacts having second mating ends in the second cavity for mating with a second receptacle connector; and header ground shields held by the header housing, the header ground shields having walls surrounding associated pairs of header signal contacts on at least two sides thereof, the header ground shields having first mating ends in the first cavity for mating with the first receptacle connector, the header ground shields having second mating ends in the second cavity for mating with the second receptacle connector, the header ground shield comprising an engagement feature integral with the corresponding header ground shield, the engagement feature having an engagement surface, wherein the engagement feature of a first header ground shield is engaged in physical contact at the engagement surface with a second header ground shields such that the first and second header ground shields are electrically connected together.

14. The header transition connector of claim 13, wherein the header ground shields are arranged in an array of rows and columns, the first and second header ground shields being arranged within the same column.

15. The header transition connector of claim 13, wherein the header ground shields are arranged in an array of rows and columns, the first and second header ground shields being arranged adjacent to each other within the same column.

16. The header transition connector of claim 13, wherein the header ground shields are arranged in an array of rows and columns, the first and second header ground shields being arranged within a first column of the columns, at least some of the header ground shields of the first column being electrically commoned with each other within the header housing.

17. The header transition connector of claim 13, wherein engagement feature is a spring arm that is engaged in physical contact with the second header ground shield to electrically connect the first and second header ground shields.

18. The header transition connector of claim 13, wherein the engagement feature is a tab that is engaged in physical contact with the second header ground shield to electrically connect the first and second header ground shields.

19. The header transition connector of claim 13, wherein the walls of the header ground shields comprise base walls and side walls that extend from the base walls, the engagement feature extends from the base wall and is engaged in physical contact with an end of a side wall of the second header ground shield to electrically connect the first and second header ground shields.

20. The header transition connector of claim 13, wherein the header ground shield is a stamped and formed structure, the engagement feature is formed from the header ground shield.

21. An electrical connector system comprising:

a receptacle connector comprising receptacle signal contacts arranged in pairs carrying differential signals, the receptacle connector comprising a ground shield having ground contacts extending therefrom; and a header transition connector coupled to the receptacle connector, the header transition connector comprising a header housing holding header signal contacts and header ground shields, the header housing having a separating wall separating a first cavity from a second cavity, the receptacle connector configured to be received in the first cavity, the header signal contacts arranged in pairs carrying differential signals, the header signal contacts having first mating ends that extend in the first cavity and are configured to be mated with the receptacle signal contacts of the receptacle connector, the header signal contacts having second mating ends that extend in the second cavity for mating with a second receptacle connector, the header ground shields having first mating ends in the first cavity for mating with the ground contacts of the receptacle connector, the header ground shields having second mating ends in the second cavity for mating with the second receptacle connector, the header ground shield comprising an engagement feature integral with the corresponding header ground shield, the engagement feature having an engagement surface, wherein the engagement feature of a first header ground shield is engaged in physical contact at the engagement surface with a second header ground shield such that the first and second header ground shields are electrically connected together.

* * * * *